US007942016B2

(12) United States Patent
Johnson et al.

(10) Patent No.: US 7,942,016 B2
(45) Date of Patent: May 17, 2011

(54) ICEMAKER EXTERNAL INTRUSION PROTECTION

(75) Inventors: Daniel L. Johnson, Cedar Rapids, IA (US); Brian M. Midlang, Cedar Rapids, IA (US); Robert Wetekamp, Newburgh, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 571 days.

(21) Appl. No.: 11/961,285

(22) Filed: Dec. 20, 2007

(65) Prior Publication Data

US 2008/0156017 A1 Jul. 3, 2008

Related U.S. Application Data

(60) Provisional application No. 60/882,266, filed on Dec. 28, 2006, provisional application No. 60/890,101, filed on Feb. 15, 2007.

(51) Int. Cl.
*F25C 1/22* (2006.01)

(52) U.S. Cl. ..... 62/340; 62/320; 222/146.6; 222/240; 222/241; 222/411

(58) Field of Classification Search ..... 62/320, 62/344; 222/146.6, 240–241, 411–413
See application file for complete search history.

(56) References Cited

U.S. PATENT DOCUMENTS

| | | | | |
|---|---|---|---|---|
| 3,640,088 | A * | 2/1972 | Jacobus et al. | 62/320 |
| 4,102,660 | A * | 7/1978 | Beckett et al. | 62/344 |
| 4,227,383 | A * | 10/1980 | Horvay | 62/344 |
| 4,678,715 | A * | 7/1987 | Giebeler et al. | 428/537.1 |
| 5,037,004 | A * | 8/1991 | Katz et al. | 222/146.6 |
| 6,666,219 | B2 | 12/2003 | Raches | |
| 6,679,082 | B1 * | 1/2004 | Tunzi | 62/344 |
| 2006/0090496 | A1 * | 5/2006 | Adamski et al. | 62/344 |
| 2007/0251259 | A1 * | 11/2007 | Kim et al. | 62/340 |
| 2009/0249820 | A1 | 10/2009 | Kim et al. | |

* cited by examiner

*Primary Examiner* — Cheryl J Tyler
*Assistant Examiner* — Justin Loffredo
(74) *Attorney, Agent, or Firm* — John W. Morrison; McKee, Vorhees & Sease, PLC

(57) ABSTRACT

A refrigerator includes a refrigerator cabinet having at least one door, an ice dispenser operatively connected to one of the at least one door having an opening for dispensing ice, an ice storage receptacle for storing ice disposed within the refrigerator cabinet, an ice crusher, an ice transfer mechanism for moving ice from the ice storage receptacle to the ice crusher, an ice chute for conveying ice from the ice crusher to the ice dispenser, and an intrusion barrier positioned within the ice chute to assist in preventing objects entering the ice chute through the ice dispenser from reaching the ice crusher without stopping ice flow through the ice chute. The ice dispenser may include a first switch and a second switch, the first switch being spaced apart from the second switch, and the ice dispenser adapted to require simultaneous activation of the first switch and the second switch to dispense ice. The ice dispenser may also include one or more sensors in the ice chute to detect objects moving toward the ice crusher.

8 Claims, 12 Drawing Sheets

ICEMAKER EXTERNAL INTRUSION PROTECTION

CROSS-REFERENCE TO RELATED APPLICATIONS

This application claims priority under 35 U.S.C. §119 to U.S. Provisional Patent Application No. 60/882,266 filed Dec. 28, 2006, and U.S. Provisional Patent Application No. 60/890,101, filed Feb. 15, 2007, both of which are hereby incorporated by reference in their entireties.

BACKGROUND OF THE INVENTION

The present invention relates to an icemaker associated with a refrigerator. More particularly, the present invention relates to preventing a user of the refrigerator from inserting an object into the icemaker through an ice chute.

It is desirable to prevent a user from inserting an object up an ice chute associated with an icemaker. Such an object may encounter the ice crusher and be damaged by the ice crusher. Such an object may also damage the ice chute or the ice crusher or interfere with proper operation of the ice dispenser. What is needed is protection against external intrusions into the ice chute.

SUMMARY OF THE INVENTION

According to one aspect of the present invention, a refrigerator includes a refrigerator cabinet having at least one door, an ice dispenser operatively connected to the door having an opening for dispensing ice, an ice storage receptacle for storing ice disposed within the refrigerator cabinet, an ice crusher, an ice transfer mechanism for moving ice from the ice storage receptacle to the ice crusher, an ice chute for conveying ice from the ice crusher to the ice dispenser, and an intrusion barrier positioned within the ice chute to assist in preventing objects entering the ice chute through the ice dispenser from reaching the ice crusher without stopping ice flow through the ice chute. The intrusion barrier may include a rod positioned across the ice chute from a first wall of the ice chute to an opposite second wall of the ice chute, a hinged door hanging from an upper front portion of the ice chute, protective fingers hanging from an upper front portion of the ice chute, or a paddle wheel. Also, the ice dispenser may require activation by pressing of multiple spaced apart buttons which require simultaneous or concurrent activation to discourage a user from placing a hand in the ice chute or an object up the ice chute towards the ice crusher during an ice dispensing operation. A front shield may be positioned outside of the ice chute and extend downwardly into a dispensing area to assist in preventing external intrusions into the ice chute. Still further yet, one or more sensors can be used to detect the presence of an object moving up the ice chute and then deactivate the ice crusher.

DETAILED DESCRIPTION

The present invention relates to preventing external intrusions into an icemaker. More particularly, the invention relates to preventing external intrusions into the icemaker in a manner which does not unduly impede the flow of ice from the ice chute to an ice dispenser.

The present invention is now described with respect to various embodiments. It is to be understood that what is described herein need not limit the invention to the specific embodiments described. It is also to be understood that elements of different embodiments may be combined together.

Figure 1:
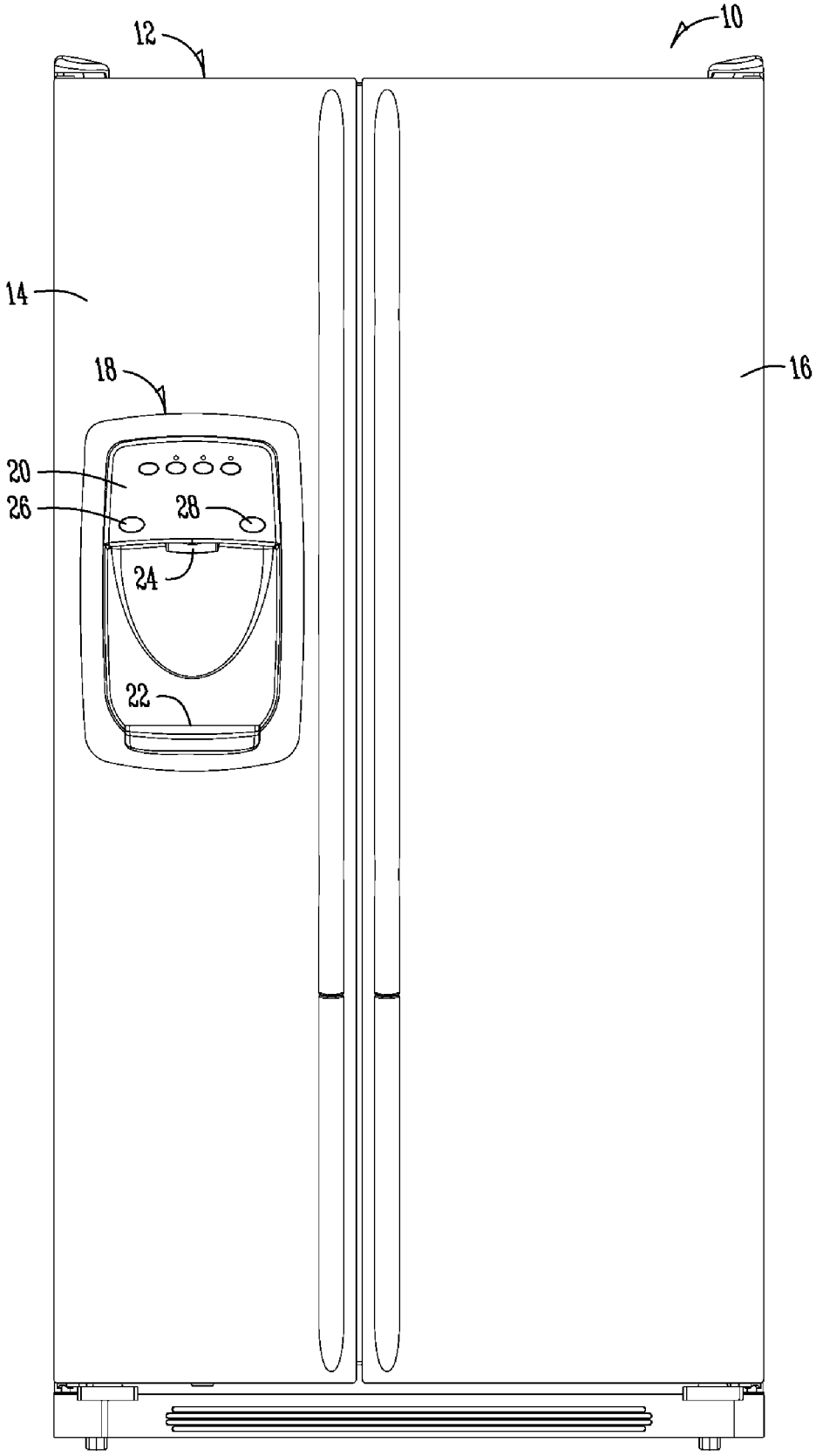
FIG. 1 is a front view of one embodiment of a refrigerator of the present invention.

FIG. 1 illustrates one embodiment of a refrigerator 10 with a side-by-side configuration. The refrigerator 10 has a refrigerator cabinet 12 which includes a frozen food compartment door 14 for accessing a frozen food compartment and a fresh food compartment door 16 for accessing a fresh food compartment. A water/ice dispenser 18 is positioned on the frozen food compartment door 14. Although a side-by-side configuration is shown with the dispenser 18 on the freezer compartment door 14, the refrigerator may be of other configurations which include a dispenser. The term "refrigerator" broadly refers to refrigeration units having a fresh food compartment or frozen food compartment alone or in combination.

Figure 2:
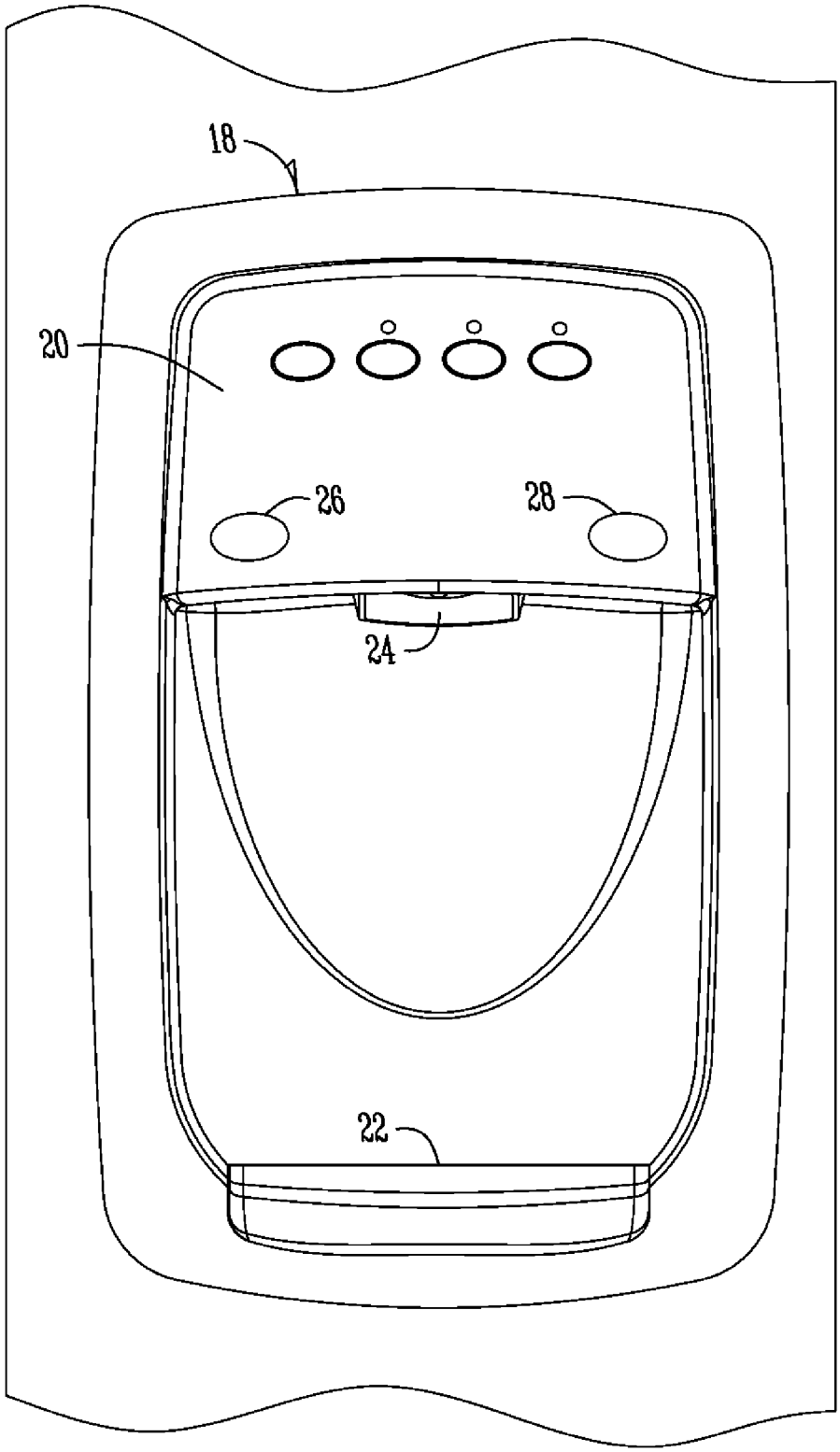
FIG. 2 is front view of one embodiment of an ice dispenser of the present invention.

FIG. 2 illustrates the dispenser 18 in more detail. The dispenser 18 includes a panel 20 upon which a user interface is disposed. The user interface may include a plurality of buttons such as buttons 26, 28. At the bottom of the dispenser 18 is a tray 22. The tray 22 may support a cup or glass or other container in which ice or water is dispensed. Near the panel 20 is an optional actuator 24 that may be used to determine if there is a container in place. The actuator 24 may be required to be actuated before dispensing is allowed.

Figure 3:
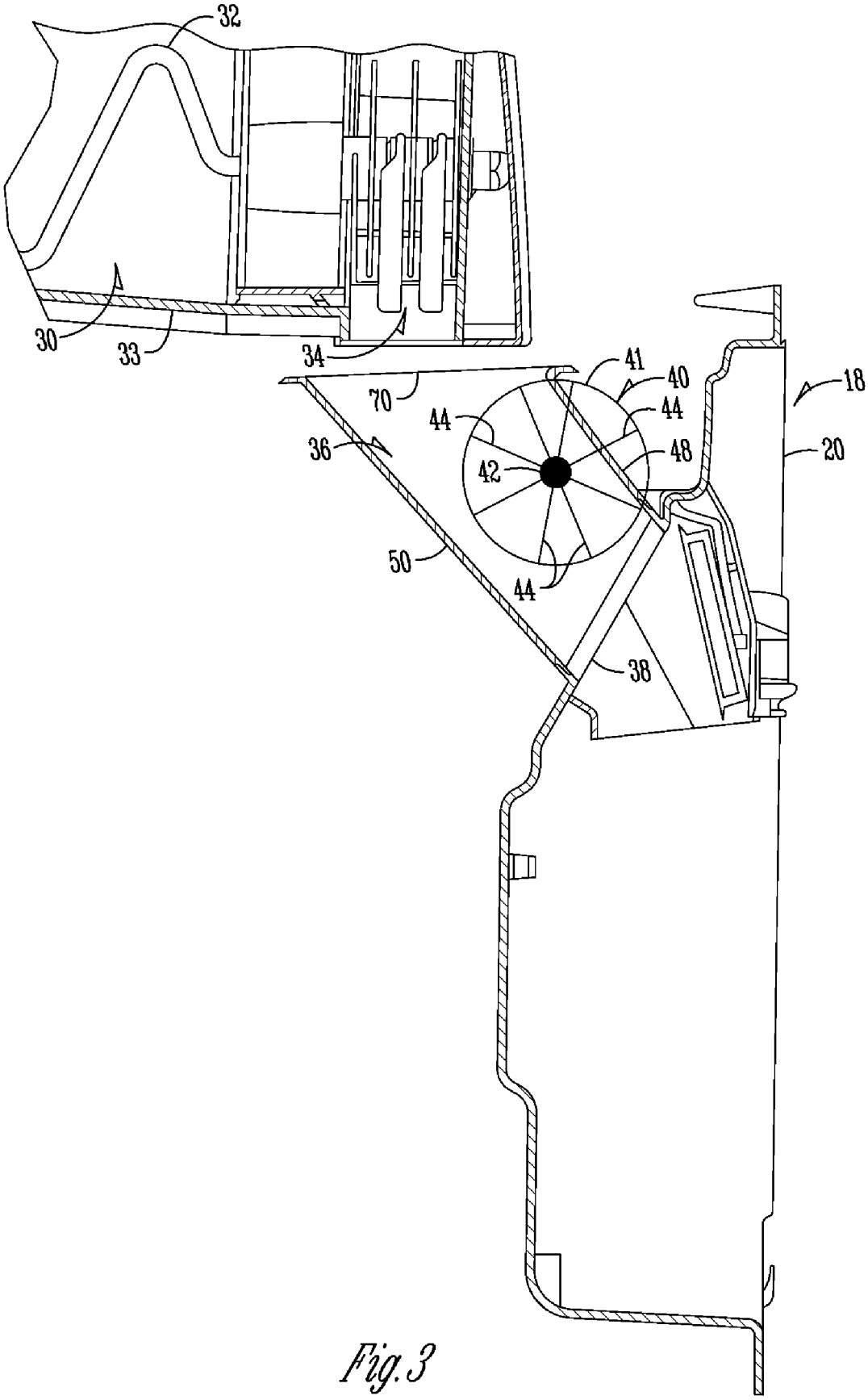
FIG. 3 is a cross-sectional view of one embodiment of an ice dispenser of the present invention where a paddle wheel is used as an intrusion barrier.

FIG. 3 provides a cross sectional view of one embodiment of the dispenser 18. The dispenser 18 shown is merely representative and other designs and configurations of dispensers are contemplated. An ice storage receptacle 30 is shown which stores cubed ice. An ice transfer mechanism 32 is shown which rotates to move ice towards the ice crusher 34.

The ice transfer mechanism 32 shown is a shaft bent into a planar serpentine shape, which in combination with sloped bottom wall 33 of the ice storage receptacle 30 moves the ice toward the ice crusher 34. Here, the ice transfer mechanism 32 agitates the ice when the shaft is rotated. Those skilled in the art will appreciate that the ice transfer mechanism 32 can also take on other forms, such as an auger with a helical coil that draws or drags ice toward the ice crusher 34.

In a preferred embodiment, the dispenser may dispense ice cubes or crushed ice. Where crushed ice is desired, the ice crusher 34 crushes the ice and conveys the ice into the ice chute 36. The ice chute 36 has a lower wall 50 and an upper wall 48. Where cubed ice is desired, the ice crusher 34 does not crush the ice but may assist in conveying the ice into the ice chute 36.

There is an opening 38 at the bottom end of the ice chute for ice to exit the dispenser. In typical operation, a user will place a cup, glass, or other container underneath the ice chute 36 for collecting the ice.

According to the embodiment shown in FIG. 3, a paddle wheel 40 is positioned within the ice chute 36. The paddle wheel 40 has an outer rim 41 and paddle blades 44. The paddle wheel 40 rotates around a central axis 42 which may be mounted to opposite sides of the ice chute 36. There is an opening in the upper wall 48 of the ice chute 36 to allow the paddle wheel to freely rotate. Alternatively, the paddle wheel 40 may be smaller in size and fit entirely within the ice chute 36.

In operation, as ice falls down the ice chute 36, if the ice contacts the paddle wheel 40, the force of the ice on the paddle blades 44 cause the paddle wheel 40 to rotate in a counter-clockwise manner, urging the ice forward through the ice chute 36 and out through the opening 38. Preferably, the paddle wheel 40 is positioned proximate but not contacting the lower wall 50 of the ice chute 36. This allows melted ice to drain down the ice chute 36.

The paddle wheel 40 also protects against intrusion into the ice chute 36 from the opening 38. If an object enters through the opening 38, its path is obstructed by the paddle wheel 40 which assists in preventing travel of the object up the ice chute 36 and into the ice crusher 34. Thus, placement of the paddle wheel 40 downstream of the ice crusher 34 protects against intrusions upstream through the ice chute to the ice crusher 34.

The paddle wheel 40 is not power-driven, but instead relies upon the force of the ice against the paddle blades 44 to rotate. The sensitivity of the paddle wheel 40 to the force of the ice may vary, but preferably only a small amount of ice is required to rotate the paddle wheel 40 and release the ice to limit the amount of ice dispensed at one time. It should be appreciated that the purpose of the paddle wheel 40 is not to convey ice but rather simply to allow ice to pass while at the same time prevent objects from moving up the ice chute 36 in an opposite direction to the flow of the ice.

Figures 4, 5:
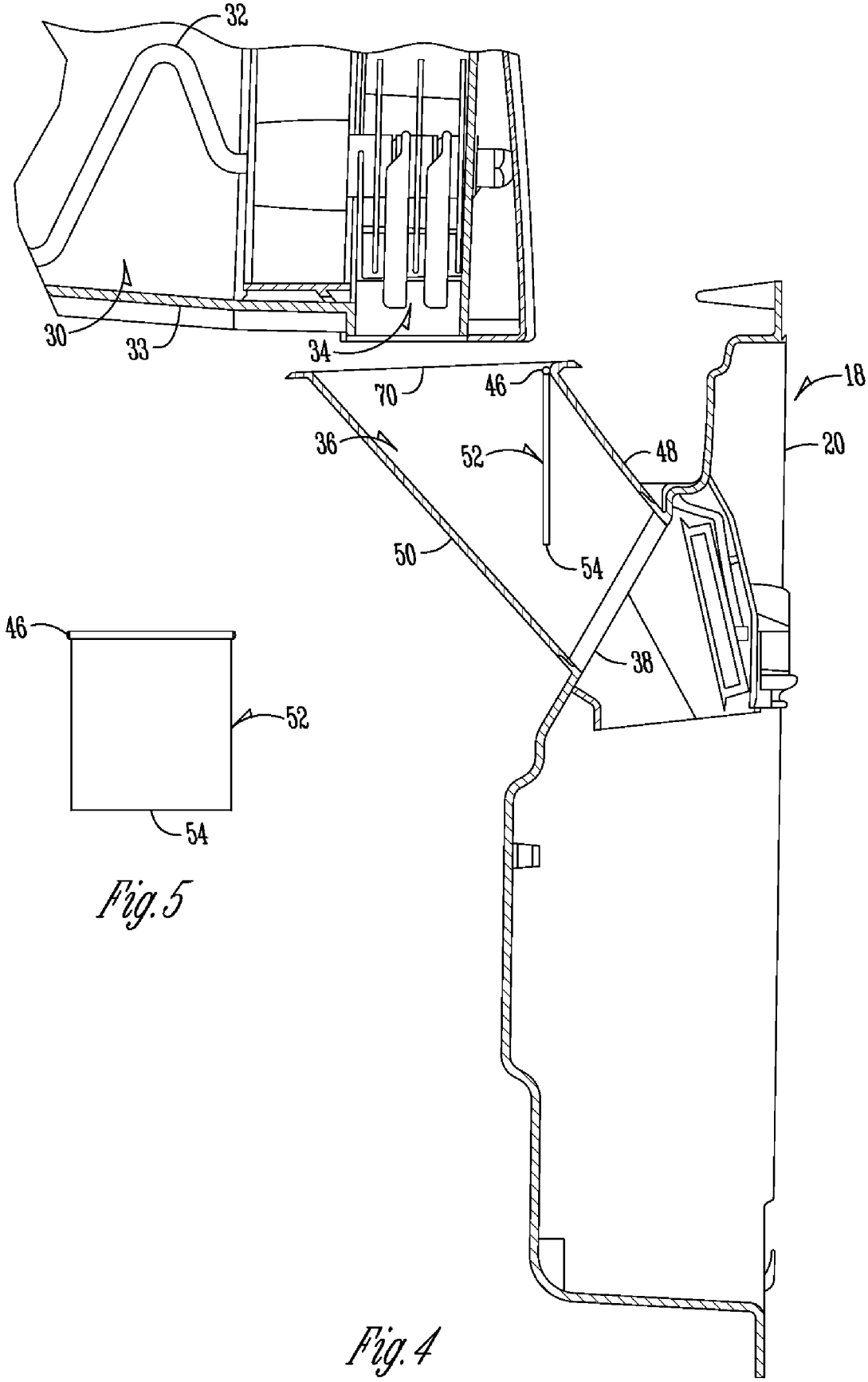
FIG. 4 is a cross-sectional view of one embodiment of an ice dispenser of the present invention where a hinged door is used as an intrusion barrier.
FIG. 5 is a front view of one embodiment of a hinged door used as an intrusion barrier.

FIG. 4 is a cross sectional view of another embodiment of the dispenser 18. In FIG. 4, there is a hinged door 52 positioned within the ice chute 36. The hinged door 52 has a hinge 46 operatively connected to the upper wall 48 of the ice chute. The door 52 extends vertically downward from the upper wall 48 of the ice chute 36. The door 52 pivots in a counter clockwise manner. In operation, ice from the ice crusher 34 may press against the door 52 urging it to open and allowing the ice to pass. The free end 54 of the door may be above the lower wall 50 of the ice chute 36. Thus, melted ice and smaller pieces of ice may flow down the ice chute 36 without being obstructed by the door 52. The hinge 46 on the door 52 may be a spring loaded hinge or other type of hinge. FIG. 5 is a front view of the door 52 with the hinge 46.

Figures 6, 7:
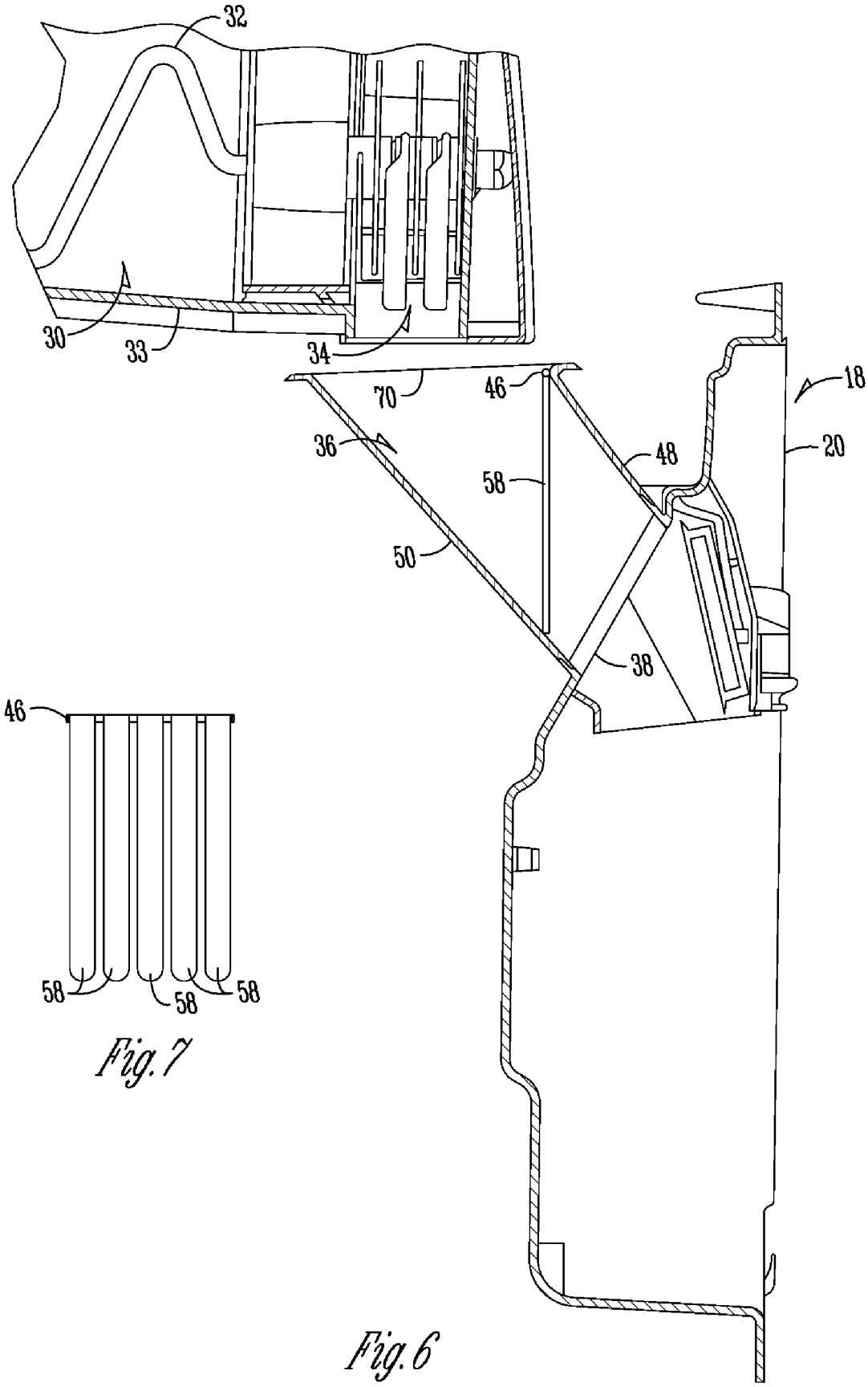
FIG. 6 is a cross-sectional view of one embodiment of an ice dispenser of the present invention where a plurality of fingers are used as an intrusion barrier.
FIG. 7 is a front view of one embodiment of a plurality of hinged fingers used as an intrusion barrier.

FIG. 6 is a cross sectional view of another embodiment of the dispenser 18. In FIG. 6, there is a hinge 46 with a plurality of fingers 58 extending vertically downwardly in the ice chute 36. The hinge 46 is operatively connected to the upper wall 48 of the ice chute. The fingers 58 extend vertically downward from the upper wall 48 of the ice chute 36. Each of the fingers 58 independently pivots in a counter clockwise manner. In operation, ice from the ice crusher 34 may press against one or more of the fingers 58 urging one or more of the fingers to pivot open to allow the ice to pass. The fingers 58 are preferably spaced apart at least slightly to allow melted ice or small ice particles to pass between the fingers. The fingers 58 may extend downwardly to the lower wall 50 of the ice chute 36, although they need not extend all the way to the lower wall 50. FIG. 7 is a front view of a plurality of fingers 58. The fingers 58 serve as an instruction barrier in that objects entering the ice chute 36 from the opening 38 are prevented from extending above the fingers 58. Thus, the ice crusher 34 is isolated and protected from such external intrusions.

Figure 8:
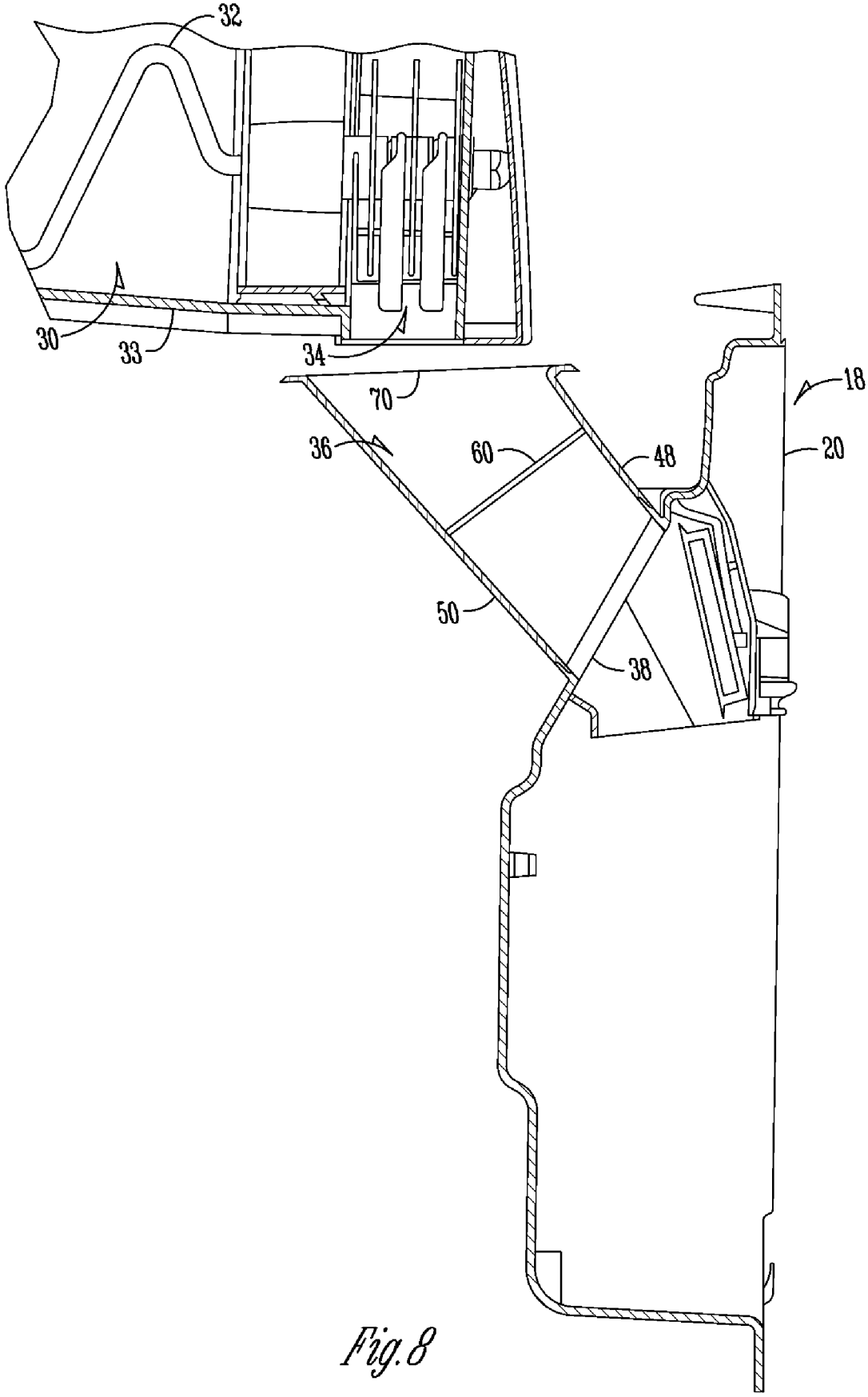
FIG. 8 is a cross-sectional view of one embodiment of the present invention where a small rod is used as an intrusion barrier.

FIG. 8 is a cross sectional view of another embodiment of the dispenser 18. In FIG. 8, a rod 60 is positioned within the ice chute 36. The rod 60 extends from the upper wall 48 to the lower wall 50 of the ice chute 36. Ice flowing down the ice chute 36 from the ice crusher 34 may pass by the rod 60. However, the rod 60 prevents larger objects which enter the opening 38 from passing beyond the rod 60.

Figure 9:
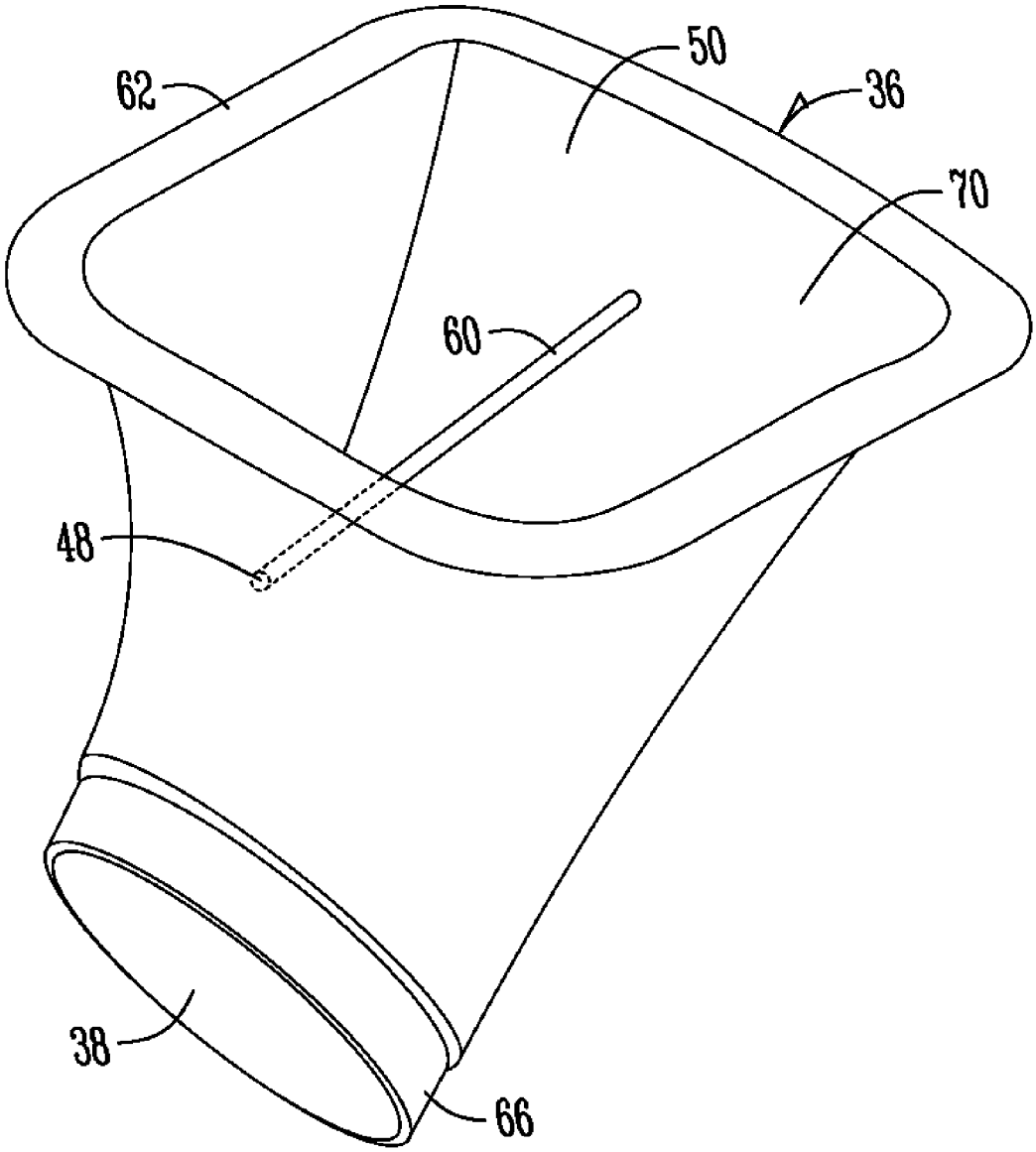
FIG. 9 is a perspective view of one embodiment of an ice chute showing placement of a small rod used as an intrusion barrier.

FIG. 9 is a perspective view of one embodiment of an ice chute 36. The ice chute 36 has an opening 38 and an opening 70. A lip 62 is positioned around the opening 70. The ice chute 36 has an upper wall 48 and a lower wall 50. The rod 60 extends between the upper wall 48 and the lower wall 50. An annular collar 66 is at the opening 38.

Another method for intrusion protection is that instead of or in addition to placing a physical barrier in the ice chute, concurrent activation of more than one switch is used to dispense ice. Thus, the ice crusher 34 associated with dispensing ice is not active unless or until there is concurrent activation of more than one switch. In FIG. 2, buttons 26, 28 are positioned on the panel 20. The buttons 26, 28 are in a spaced apart relationship, such at opposite ends of the panel 20. The placement of the buttons is such that a user will not be able to conveniently press both button 26 and button 28 at the same time without use of both hands. Such a placement of buttons is advantageous as if both hands of the operator are in use to dispense ice, the hands of the user are not within the ice chute. In addition, such a placement of the buttons may encourage a user to place his/her container on the tray 22 while ice is dispensed. Placement of the container on the tray may assist in preventing spillage of ice outside of the container.

Figure 10:
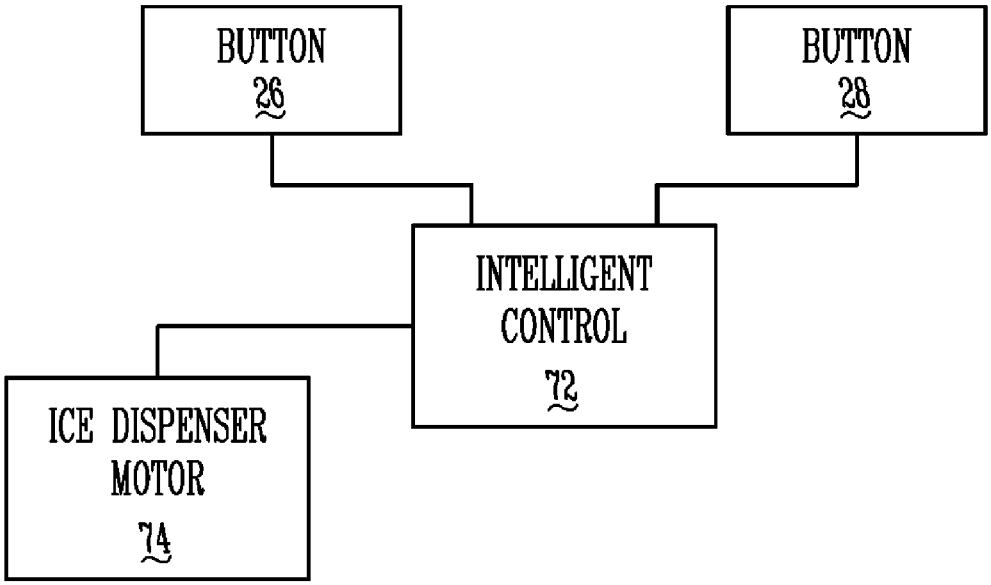
FIG. 10 is a block diagram of one embodiment of a control system of the present invention where concurrent activation is used to assist in preventing external intrusions.

FIG. 10 provides a block diagram of an electrical system of the dispenser. An intelligent control 72 is shown which is electrically connected to a first button 26 and a second button 28. The intelligent control 72 is also electrically connected to an ice dispenser motor 74. The intelligent control 72, among other functions, may require that button 26 and button 28 be concurrently activated in order to active the ice dispenser motor 74. The intelligent control 72 may be a microcontroller, processor, integrated circuit, or other type of intelligent control.

Figure 11:
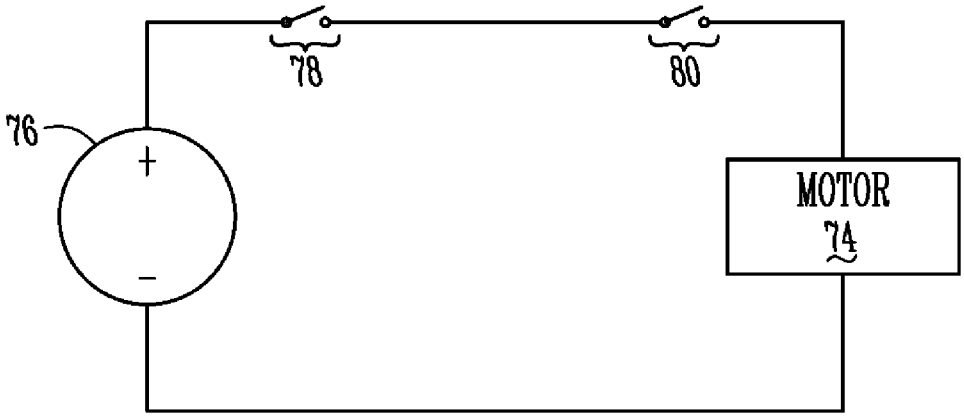
FIG. 11 is an electrical schematic of another embodiment of a control system of the present invention where concurrent activation is used to assist in preventing external intrusions.

FIG. 11 is an electrical schematic showing another embodiment for requiring multiple buttons or other switches be activated in order to drive a motor. In FIG. 11, a power source 76 is electrically connected to a first switch 78 which is in series with a second switch 80 which is electrically connected to the ice dispenser motor 74. In such a configuration, both the first switch 78, which may be a push button, sensor switch, or other type of switch, and the second switch 80 must be closed in order to power the ice dispenser motor 74.

Figure 12:
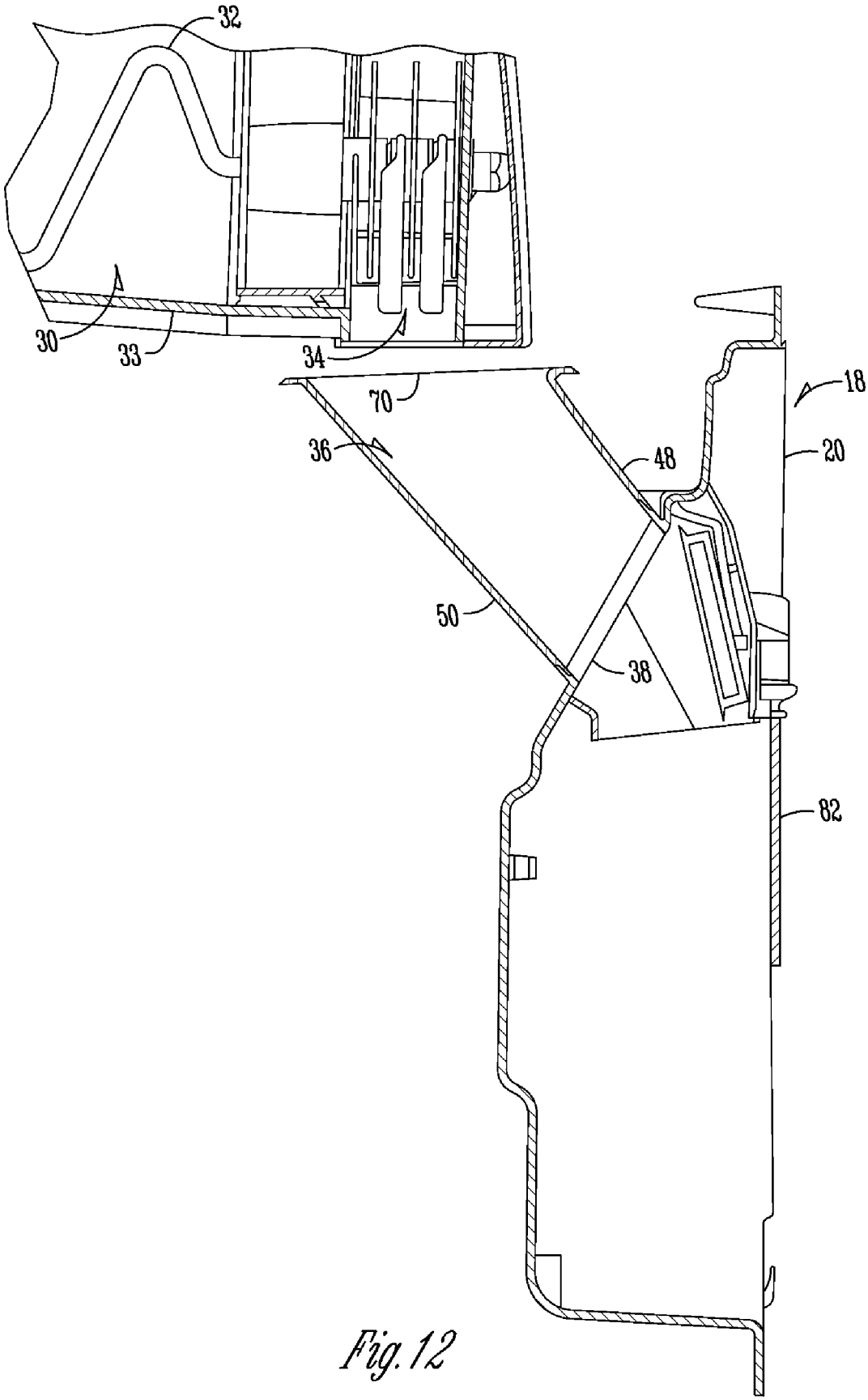
FIG. 12 is a cross-sectional view of one embodiment of an ice dispenser of the present invention where a front shield assists in preventing external intrusions.

FIG. 12 is a cross sectional view of one embodiment of an ice dispenser 18. The dispenser 18 shown is merely representative and other designs and configurations of dispensers are contemplated. An ice storage receptacle 30 is shown which stores cubed ice. An ice transfer mechanism 32 is shown which rotates to move ice towards the ice crusher 34. In a preferred embodiment, the dispenser may dispense ice cubes or crushed ice. Where crushed ice is desired, the ice crusher 34 crushes the ice and conveys the ice into the ice chute 36. The ice chute 36 has a lower wall 50 and an upper wall 48. Where cubed ice is desired, the ice crusher 34 does not crush the ice but may assist in conveying the ice into the ice chute 36.

There is an opening 38 at the bottom end of the ice chute for ice to exit the dispenser. In typical operation, a user will place a cup, glass, or other container underneath the ice chute 36 for collecting the ice. A front shield 82 is shown. The front shield 82 may be of various shapes, widths, heights, and angularities. The front shield 82 may be attached to the ice dispenser 18 in various ways and may have various numbers of attachment points. The front shield 82 serves as an intrusion barrier to moving parts.

Figure 13:
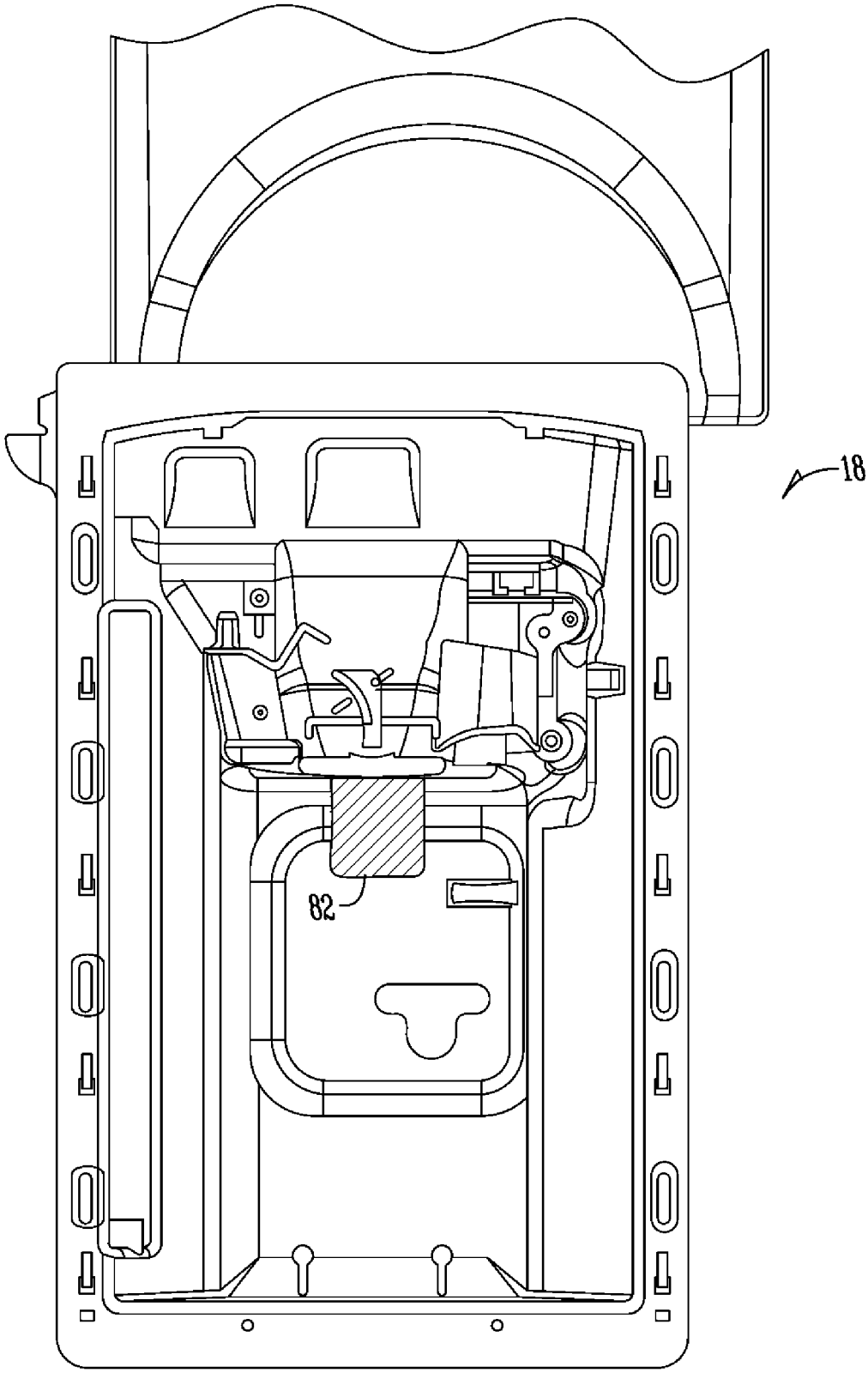
FIG. 13 is front view of one embodiment of an ice dispenser unit with a front shield.

FIG. 13 is a front view showing one embodiment of an ice dispenser 18 with the front shield 82 serving as an intrusion barrier. The front shield is positioned at the front of the ice dispenser 18 which is partially exposed in the front of a refrigerator for operation by a user. The front shield 82 extends downwardly and in front of the dispensement area where a user would place a container such as a glass or cup to receive ice. Returning to FIG. 12, the placement of the front shield 82 assists in preventing external intrusions into the ice chute 36 of the ice dispenser 18. When the front shield 82 is present, additional physical constraints assist in preventing objects from entering the ice chute 36. The physical constraints include removing the shortest and most direct paths than an object would need to travel in order to reach the ice chute 36. Thus, the front shield 82 serves as an intrusion barrier. The front shield 82 may be a thin plastic or metal member or formed of other materials.

Figure 14:
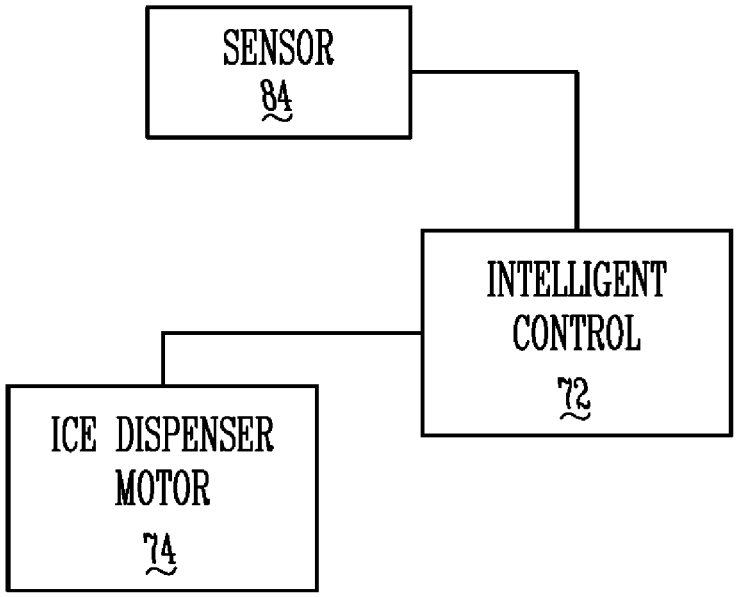
FIG. 14 is a block diagram of one embodiment of a control system of the present invention where one or more sensors are used to detect the presence of objects entering the ice chute.
Figure 15:
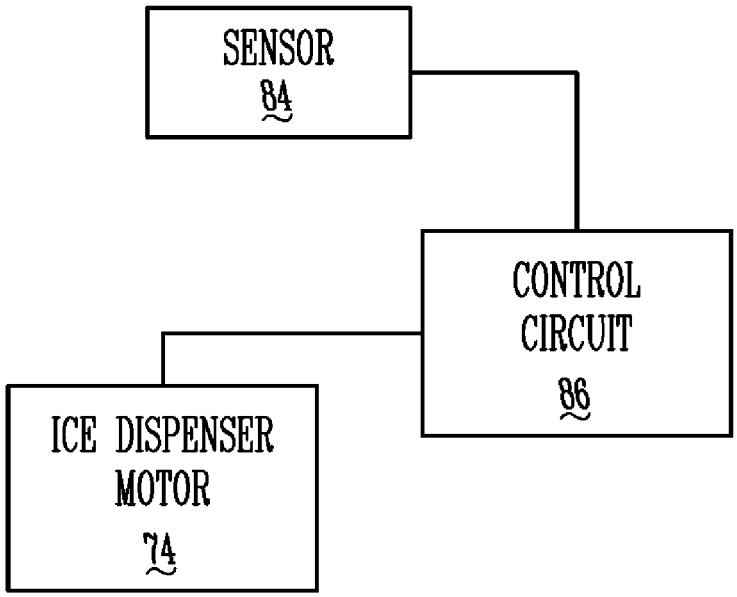
FIG. 15 is a block diagram of another embodiment of a control system of the present invention where one or more sensors are used to detect the presence of objects entering the ice chute.
Figure 16:
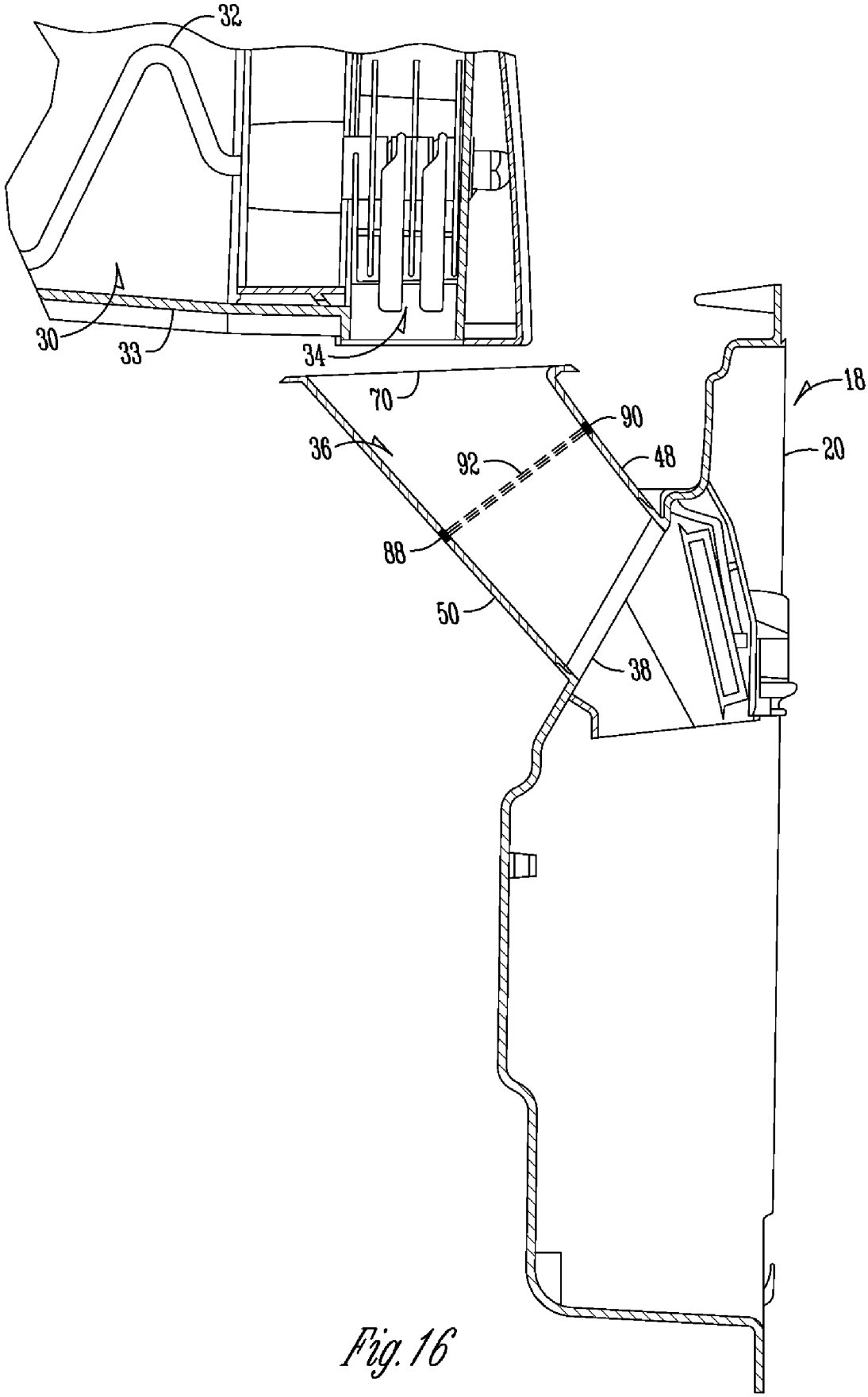
FIG. 16 is a cross-sectional view one embodiment of the present invention where a light sensor and detector are used as an intrusion barrier.

An alternative form of the present invention is illustrated in FIGS. 14-16, which contemplates one or more sensors used to detect the presence of an object entering the ice chute 36 from outside of the refrigerator 10. FIG. 14 is a block diagram of an electrical system. An intelligent control 72 is shown which is electrically connected to a sensor 84 and the ice dispenser motor 74. The intelligent control 72, among other functions, may deactivate the ice dispenser motor 74 when the sensor 84 detects the presence of an object entering the ice chute. The intelligent control 72 may be a microcontroller, processor, integrated circuit, or other type of intelligent control.

The intelligent control 72 is but one type of control circuit that can be used with the present invention. FIG. 15 is similar to the block diagram of FIG. 14 wherein a control circuit 86 is used to deactivate the ice dispenser motor 74. The control circuit 86 may be an analog circuit, such as a switch and capacitor. In a preferred form, the switch would normally be closed. When the sensor 84 detects an object entering the ice chute 36, the switch would be opened, thereby deactivating the ice dispenser motor 74. The control circuit 86 can also include an analog circuit having a relay, opto-isolator or other control circuit for disconnecting power or otherwise interrupting operation of the ice dispenser motor 74.

FIG. 16 is a cross-sectional view of an embodiment of an ice dispenser with a sensor, in the form of a light emitter 88 and corresponding detector 90. A light beam or curtain 92 is created through use of the light emitter 88. A corresponding detector or receiver 90 is placed opposite the light emitter 88 along the wall of the ice chute 36 so that light emitted by the emitter 88 is received by the detector 90 when the light beam or curtain 46 is unobstructed. An object moving through the ice chute 36 thus interrupts the reception of the light beam 46. Of course, it is possible for ice flowing through the ice chute 36 to interrupt the light beam 46; however, an object moving toward the ice crusher will normally interrupt reception of the light beam 46 for a longer period of time. Thus, one way to distinguish between ice flowing through the ice chute 36 during normal operation and an object moving toward the ice crusher 34 is to deactivate the ice dispenser motor 74 only after the detector 90 has not received light for a pre-determined amount of time. The threshold amount of time may be different based upon the size and shape of cubed ice dispensed.

The present invention contemplates variations in the type of sensor used. The sensor can be a touch sensitive sensor, an LED emitter and detector, an infrared light emitter and detector or other variations.

The present invention contemplates numerous variations in the structure and configurations of the intrusion barriers, the placement of buttons or switches, and other variations that fall within the spirit and scope of the claimed invention.

What is claimed is:

1. A refrigerator, comprising:

a refrigerator cabinet having at least one door;

an ice dispenser operatively connected to one of the at least one door having an opening for dispensing ice;

an ice storage receptacle for storing ice disposed within the refrigerator cabinet;

an ice crusher;

an ice transfer mechanism for moving ice from the ice storage receptacle to the ice crusher;

an ice chute for conveying ice from the ice crusher to the ice dispenser;

an intrusion barrier positioned within the ice chute to assist in preventing objects entering the ice chute through the ice dispenser from reaching the ice crusher without stopping ice flow through the ice chute;

wherein the intrusion barrier comprises a wheel;

the wheel is a paddle wheel comprising an outer rim and a plurality of paddle blades operatively connected to the outer rim to assist in preventing intrusions in the ice chute; and a second intrusion barrier positioned outside of the ice chute to assist in preventing external intrusions into the ice chute.

2. A refrigerator, comprising:

a refrigerator cabinet having at least one door;

an ice dispenser operatively connected to one of the at least one door having an opening for dispensing ice;

an ice storage receptacle for storing ice disposed within the refrigerator cabinet;

an ice crusher;

an ice transfer mechanism for moving ice from the ice storage receptacle to the ice crusher;

an ice chute for conveying ice from the ice crusher to the ice dispenser;

an intrusion barrier positioned within the ice chute to assist in preventing objects entering the ice chute through the ice dispenser from reaching the ice crusher without stopping ice flow through the ice chute;

a second intrusion barrier positioned outside of the ice chute to assist in preventing external intrusions into the ice chute; and the second intrusion barrier comprises at least one sensor for detecting the presence of an object entering the ice chute, the at least one sensor electrically connected to a control circuit, the control circuit configured to turn off the ice crusher when the presence of the object is detected.

3. The refrigerator of claim 2 wherein the control circuit is adapted to distinguish between ice flowing through the chute and the presence of an object entering the chute from outside of the refrigerator.

4. The refrigerator of claim 3 wherein the at least one sensor detects the presence of the object for a predetermined time to distinguish between ice flowing through the chute and the object entering the chute from outside of the refrigerator.

5. A refrigerator, comprising:

a refrigerator cabinet having at least one door;

an ice dispenser operatively connected to one of the at least one door having an opening for dispensing ice;

an ice storage receptacle for storing ice disposed within the refrigerator cabinet;

an ice crusher;

an ice transfer mechanism for moving ice from the ice storage receptacle to the ice crusher;

an ice chute for conveying ice from the ice crusher to the ice dispenser;

a paddle wheel positioned within the ice chute to assist in preventing objects entering the ice chute through the ice dispenser from reaching the ice crusher without stopping ice flow through the ice chute;

a front shield positioned outside of the ice chute and extending downwardly into a dispensing area to assist in preventing external intrusions into the ice chute; and wherein the paddle wheel comprises an outer rim and a plurality of paddle blades operatively connected to the outer rim to assist in preventing intrusions in the ice chute.

6. The refrigerator of claim 5 wherein the ice dispenser further comprises a first switch and a second switch, the first switch being spaced apart from the second switch, and the ice dispenser adapted to require simultaneous activation of the first switch and the second switch to dispense ice.

7. A refrigerator, comprising:

a refrigerator cabinet having at least one door;

an ice dispenser operatively connected to one of the at least one door having an opening for dispensing ice;

an ice storage receptacle for storing ice disposed within the refrigerator cabinet;

an ice crusher;

an ice transfer mechanism for moving ice from the ice storage receptacle to the ice crusher;

an ice chute for conveying ice from the ice crusher to the ice dispenser;

a plurality of switches associated with the ice dispenser;

wherein the ice dispenser is adapted to require concurrent activation by a user of each of the plurality of switches before dispensing ice; and a front shield positioned outside of the ice chute and extending downwardly into a dispensing area to assist in preventing external intrusions into the ice chute;

an intrusion barrier positioned within the ice chute to assist in preventing objects entering the ice chute through the ice dispenser from reaching the ice crusher without stopping ice flow through the ice chute;

wherein the intrusion barrier comprises a wheel; and wherein the wheel is a paddle wheel comprising an outer rim and a plurality of paddle blades operatively connected to the outer rim to assist in preventing intrusions in the ice chute.

8. The refrigerator of claim 7 further comprising an intelligent control electrically connected to the plurality of switches and a motor and wherein the intelligent control is adapted to activate the motor after concurrent activation of the plurality of switches.

* * * * *